United States Patent [19]

Lingl

[11] 4,328,724

[45] May 11, 1982

[54] METHOD AND APPARATUS FOR CUTTING BRICK MOULDINGS FROM A CLAY STRAND

[75] Inventor: Hans Lingl, Neu-Ulm, Fed. Rep. of Germany

[73] Assignee: Lingl Corporation, Paris, Tenn.

[21] Appl. No.: 212,343

[22] Filed: Dec. 3, 1980

Related U.S. Application Data

[63] Continuation of Ser. No. 52,417, Jun. 27, 1979, abandoned.

[30] Foreign Application Priority Data

Jun. 29, 1978 [DE] Fed. Rep. of Germany ..... 2828534

[51] Int. Cl.[3] ..... B28B 11/14

[52] U.S. Cl. ..... 83/23; 83/155; 83/168; 83/278; 83/437; 83/578; 83/636; 83/651.1

[58] Field of Search ..... 83/23, 56, 109, 149, 83/150, 155, 155.1, 168, 278, 437, 578, 620, 636, 651.1

[56] References Cited

U.S. PATENT DOCUMENTS

| | | | |
|---|---|---|---|
| 1,275,775 | 8/1918 | Simmonds | 83/651.1 X |
| 2,099,119 | 11/1937 | King et al. . | |
| 3,461,196 | 8/1969 | Bowles . | |
| 3,492,703 | 2/1970 | Bergling et al. . | |
| 3,602,963 | 9/1971 | Lingl | 83/651.1 X |
| 3,805,655 | 4/1974 | Virijma | 83/651.1 X |
| 3,838,621 | 10/1974 | Keck | 83/651.1 X |
| 4,085,635 | 4/1978 | Lingl | 83/651.1 X |

FOREIGN PATENT DOCUMENTS

| | | | |
|---|---|---|---|
| 2453934 | 5/1976 | Fed. Rep. of Germany | 83/651.1 |
| 290928 | 5/1928 | United Kingdom . | |
| 601494 | 5/1948 | United Kingdom . | |
| 630451 | 10/1949 | United Kingdom . | |
| 683421 | 11/1952 | United Kingdom . | |
| 805815 | 12/1958 | United Kingdom . | |

*Primary Examiner*—James M. Meister

*Attorney, Agent, or Firm*—Cushman, Darby & Cushman

[57] ABSTRACT

A block of material such as a clay is fed onto a support comprising spaced apart supports, and a cutting frame, having tensioned cutting wires, is moved in a substantially vertical plane through the block and between the supports so that the cutting wires cut completely through the block without interruption of the cutting motion. The cutting wires lie in a plane extending at an acute angle to the plane of feed of the block. The cut block is then removed from the support. Feeding of the block onto the support and removal of the cut block from the supports occurs in a single plane and are effected substantially simultaneously by means of a pushing device. The method and apparatus of this invention is particularly applicable to the cutting of individual clay batches into a number of individual brick mouldings. An advantage of a preferred embodiment of this invention is that cut portions can be produced without marking of the cutting surfaces and/or the cutting edges of the cut portions.

18 Claims, 4 Drawing Figures

METHOD AND APPARATUS FOR CUTTING BRICK MOULDINGS FROM A CLAY STRAND

This is a continuation, of application Ser. No. 52,417 filed June 27, 1979, now abandoned.

BACKGROUND OF THE PRESENT INVENTION

This invention relates to a method of, and to apparatus for, cutting a block of material such as clay, particularly cutting a clay batch into brick mouldings.

In this regard, reference is made to another copending application Ser. No. 942,034 filed on Sept. 13, 1978, as well as earlier, commonly assigned U.S. Pat. Nos. 3,602,963, 3,976,417 and 4,085,635. Additionally, other known devices for cutting clay columns include the following U.S. Pat. Nos. 1,275,775, 2,099,119, 3,461,196, 3,492,703, 3,805,655 and 3,838,621.

These devices include those where clay columns are pushed through a cutting frame at right angles to the primary feed direction, as in U.S. Pat. Nos. 3,461,196 and 3,602,963. Traditionally the columns are pushed quite hard and there are many types of bricks where such hard pushing is undesirable since either the column, the resulting cut members or both would be damaged. Another push type is shown in U.S. Pat. No. 3,805,655.

Cutting wires have also been placed in rotating frames as in U.S. Pat. No. 1,275,775 for cutting file which is supported on a conveyor belt or have been part of a punching tool as in U.S. Pat. No. 3,976,417.

Cutting clay columns with a cutting device by means of a cutting frame, supported so that it can rotate, in which cutting wires are located at intervals from each other is also known and reference is made to U.S. Pat. No. 3,838,621. The column is conveyed on a transportation device comprised of a number of arrow conveyor belts located close to each other, and the cutting wires sink into holes defined between the belts after every cut.

The disadvantage of this apparatus is that a separate belt table or assembly line must be available for each cut length so that changing cutting lengths is a very time-consuming and expensive operation. Another disadvantage is that the clay columns are not completely supported during cutting, so that the lower edges of bricks can be deformed when being cut. Further, the wires can only be cleaned after every cut by a relatively time-and-energy-consuming device, and since the cleaning device has to be moved along the wires while they are held in a stationary position an additional time delay factor is created. A similar device is disclosed in U.S. Pat. No. 4,085,635, and an improved system is disclosed in the copending application Ser. No. 924,034. U.S. Pat. No. 2,099,119 discloses a device for cutting yeast that operates through slots in a manner somewhat similar to those that operate within slots that extend transversely across the path of the yeast. Finally, U.S. Pat. No. 3,492,703 discloses a vertical cutter for concrete that moves up and down in a sawing fashion. It does not move through the work in a single pass and would not produce cuts that would be free of marks.

German patent specification No. 2,453,934 discloses a method and apparatus for cutting brick mouldings from a clay strand in which elongate clay batches are passed to a cutting frame provided with cutting wires. The cutting frame is pivotably supported at one side so as to be pivotable about a shaft disposed below the path of the batch. In use, the cutting frame is pivoted upwardly during forward feed of the batch, which forward feed is effected by means of a pusher, at a speed adapted to the feed of the batch so that the exit of the cutting wires from the surface of the batch remains at the same place and that part of the cutting wires within the batch moves longitudinally of the batch. Forward feed of the batch is then stopped and the cutting frame is pivoted downwardly to return to the starting position thereof so that the wires complete the cut through the batch and penetrate into the succeeding batch.

The disadvantage of this apparatus is that, because the batches are cut in two intermittent strokes and the wires remain in the batch between the strokes, a clearly visible mark occurs at the cutting surfaces and edges of the brick after the end of the forward feed due to the relaxation of the wires and of the batches.

Another disadvantage of that apparatus is that, due to the wide angle required between the wires and the batch support surface at the beginning of the cut, the batch which is to be cut must be supported against the succeeding batch to prevent displacement. The quality of such a support depends on the shape and weight of the batch so that, more particularly when cutting lightweight material, such as hollow bricks, the cutting quality varies from cutting phase to cutting phase due to the varying cutting pressure against the direction of feed.

German patent specification No. 2,511,158 discloses an apparatus similar to that disclosed in German patent specification No. 2,453,934 but differing therefrom in that the cutting frame is pivoted about a shaft above the path of the batch and by virtue of the fact that no pusher is used to feed the batch.

The apparatus of German patent specification No. 2,511,158 is detrimental for the same reasons as those previously described in connection with German patent specification No. 2,453,934. The most serious problem, however, is that the cutting surfaces and edges of the mouldings become marked by the wires which remain within the batch between cuts.

SUMMARY OF THE PRESENT INVENTION

According to a first aspect of this invention there is provided a method of cutting a block of material, such as clay. The method comprises feeding a block of material onto support means comprising spaced apart supports, moving a cutting frame and having tensioned cutting wires, positioned in a substantially vertical plane, move through the block and between the supports so that the cutting wires completely cut through the block without an interruption in the cutting motion. The cutting wires lie in a plane extending at an acute angle to the plane of feed of the block, and following cutting the removal of the cut block from the support means. The feeding of the block onto the support means and removal of the cut block from the support means occurs in a single plane and is effected by means of suitable pushing means.

According to a second aspect of this invention there is provided an apparatus suitable for use in cutting a block of material, such as clay, which apparatus comprises pusher means including a first pusher for feeding a block of material onto the support means which supports the block during cutting and a second pusher for removing the cut block from the support means. The first and second pushers push in a single plane. The apparatus also uses a cutting frame, having tensioned cutting wires, which is movable in a substantially vertical plane through a block supported by the support means and between the spaced apart supports to cut completely through the block without any interruption in the cutting motion. The cutting wires are positioned in a plane that extends at an acute angle to the plane of feed of the block onto the support means.

Preferred exemplary embodiments of this invention provide a method and apparatus by means of which cut portions, such as brick mouldings, can be produced with cutting surfaces which have no markings resulting from an intermittent cutting operation and in which the cutting edges are also free of any such markings.

Advantageously, a first pusher of the pusher means feeds a block to be cut towards and onto the support means while a second pusher of the pusher means removes a cut block from the support means. The first and second pushers preferably move in a substantially vertical plane to and from an operative pushing station, at which station the pushers push the block horizontally from a starting position to a final position. Preferably, the cutting frame, after cutting, moves in a substantially vertical plane to return to its original starting position. During pushing of the block to be cut and of the cut block, the pushing means does not contact the wires nor are the wires contacted during the return movement of the cutting frame.

Advantageously, the first and second pushers move downwardly with the cutting frame during cutting to their starting position so that they are in position following cutting. After cutting, the cutting frame moves upwardly to return to its starting position while the first pusher feeds a new block towards and onto the support means and the second pusher simultaneously removes the cut block from the support means. Thereafter, when this feeding of a new block and the removal of the cut block is completed, the pushers move upwardly in a substantially vertical plane and thereafter move in a substantially horizontal plane to return to a position directly above their starting position.

This invention is particularly applicable to the cutting of clay batches or predetermined lengths of a clay column, such as a clay batch cut from a strand or column of extruded clay, into individual brick mouldings.

In a preferred embodiment of this invention, a clay batch is divided in one operation into individual brick mouldings and the cutting wires perform a downwardly oriented motion so that cutting is continuous and the cutting pressure in all cutting phases remains uniform as a result of which clean cutting surfaces and clean cutting edges are obtained. Setting the cutting frame at an angle enables the individual cut mouldings to be pushed out of the cutting area and a new batch to be pushed into cutting position during the upward motion of the cutting frame between the cutting strokes thereby leading to a high output rate with a simple method of operation. Furthermore, in a preferred embodiment of the apparatus, batches of cut mouldings are pushed in and out by the same pusher device thereby reducing the mechanical complexity of the apparatus.

DESCRIPTION OF THE DRAWINGS

For a better understanding of this invention and to show how the same may be put into effect, reference will now be made, by way of example, to the accompanying drawings, in which.

DETAILED DESCRIPTION OF THE PREFERRED EXEMPLARY EMBODIMENT

Figure 1:
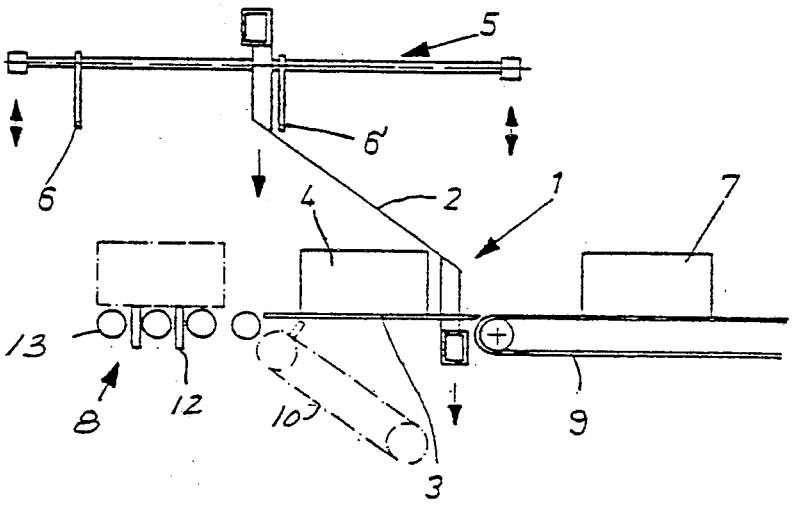
FIG. 1 shows a diagrammatic side view of a preferred exemplary embodiment of an apparatus made in accordance with this invention showing the cutting frame and pusher device both in their raised, initial position.

Referring to the drawings, specifically to FIG. 1, a cutting frame 1 is shown as having a plurality of tensioned cutting wires 2 for cutting a clay batch 4 situated on a slotted support plate 3. The clay batch 4 which is to be cut next has been pushed from a roller table 8 onto the support plate 3 by a first part of pusher means 5 while the batch previously cut into brick mouldings 7 by the cutting wires 2 has already been pushed by a second part of pusher means 5 onto a belt conveyor 9. This movement of clay batches and cut mouldings will be more fully explained in detail hereinafter.

Figure 2:
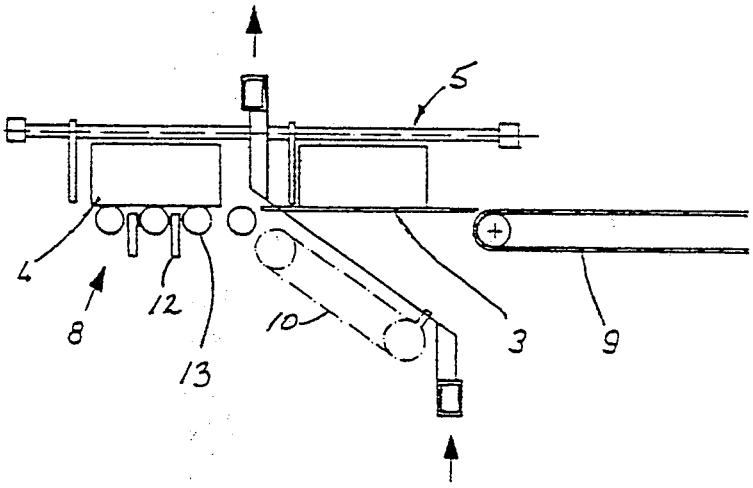
FIG. 2 shows a diagrammatic side view of the apparatus of FIG. 1 after a completed cutting stroke.

The cutting frame 1 is movable vertically downwards from a raised initial position, as shown in FIG. 1, to cut a clay batch 4 situated on the support plate 3 into brick mouldings 7 (see FIG. 2) and also upwardly following cutting to return to that starting position as the clay is moved.

Support plate 3 is slotted so that it can both support the clay and allow cutting wires 2 to pass therethrough during cutting. A combined wire cleaner and waste clay conveyor 10 is situated below the support plate 3 to cooperate with the wires 2 to clear the wires 2 and to convey the waste clay for disposal.

Pusher means 5 comprises rail means 11 from which pushers extend, in this embodiment pusher bars 6 and 6', and along which pusher bars 6 and 6' can move in the same horizontal plane. Pusher bars 6 and 6' are situated at a distance from each other which corresponds to the maximum length of the brick mouldings 7 cut from the clay batch 4 (normally equal to the maximum width of the clay batch 4) plus a distance which is sufficient to guide the wires 2 and allow them to pass between the exiting brick mouldings 7, that is the brick mouldings 7 being removed to the belt conveyor 9, and the incoming clay batches 4 so that the brick mouldings 7 and the clay batches 4 are not touched by the wires 2. Since there are a number of ways to drive or operate pusher means 5, it is sbmitted that any further explanation or detailed description is not essential for a full and complete description and an understanding of the invention by one skilled in this art.

A roller table 8 is provided with vertically movable conveyor means 12 and rollers 8 and is otherwise constructed and operated in a conventional manner.

As shown, cutting wires 2 lie in an inclined plane which forms an acute angle with the inlet plane of the clay batches 4 onto the support plate 3.

In use, a first operating stage of the components is shown in FIG. 1. A clay batch 4 which is to be cut next is situated on support plate 3 and brick mouldings 7 already cut from a previous clay batch are on belt conveyor 9 ready for further downstream travel. The clay batch 4 and the brick mouldings 7 have already been transferred by the operation of pusher means 5. A further clay batch 4 to be cut (shown in discontinuous lines) is situated on conveyor means 12 of the roller table 8, the clay batch 4 having been conveyed to the required position by an upstream conveyor means (not shown). During the cutting stroke, the cutting frame 1 moves vertically downwards so that the cutting wires 2 cut completely through the clay batch 4 without interruption in the cutting motion to form brick mouldings 7 and to pass through the support plate 3 to the position shown in FIG. 2. The combined cutter cleaner and waste clay remover 10 moves during cutting to clean the wires and to convey away dry waste clay. Pusher means 5 moves downwardly along with cutting frame 1 so that on completion of cutting pusher bars 6 and 6′ are respectively operatively positioned to push the clay batch 4 and the newly cut brick mouldings 7. On movement of the pusher bars 6 and 6′ along the rail means 11 in a single horizontal plane the pusher bar 6 contacts and pushes clay batch 4, now positioned on the rollers 13 after downward movement of the conveyor means 12, towards and onto the support plate 3 while pusher bar 6′ contacts and pushes the just cut brick mouldings 7 from the support plate 3 onto belt conveyor 9.

Figure 3:
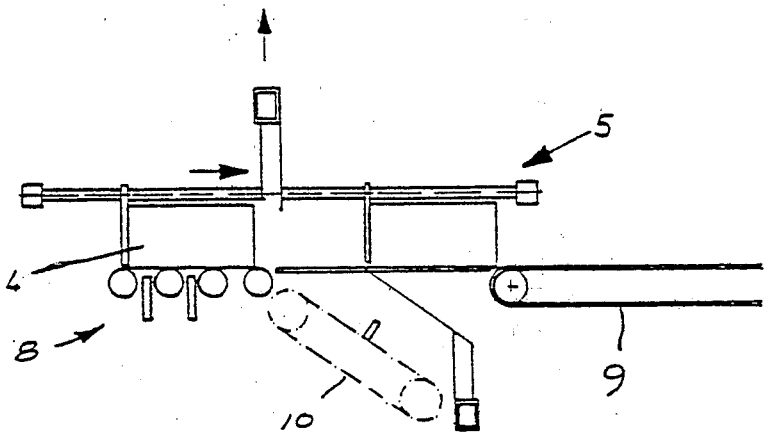
FIG. 3 shows a diagrammatic side view of the apparatus of FIG. 1 during upward movement of the cutting frame and horizontal pushing by the pushing means.

During pushing by the pushing means 5, the cutting frame 1 moves upwardly as shown in FIG. 3 to return to its initial raised position. The pusher means 5 is moved so as to follow the intersection of the cutting wires 2 with the plane of feed of the clay block 4 and brick mouldings 7 so that the cutting wires 2 remain at a free distance between the clay batches 4 and the brick mouldings 7 during upward movement thereof. Also as shown, the waste remover and conveyor 10 returns towards the initial position thereof.

Figure 4:
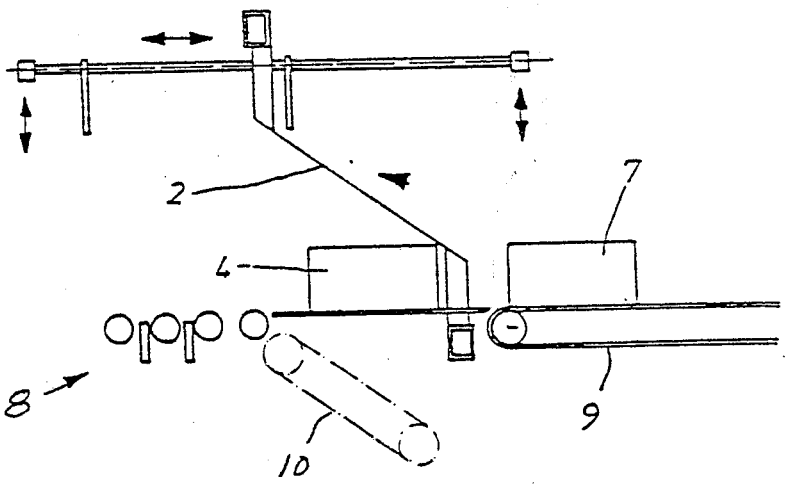
FIG. 4 shows a diagrammatic side view of the apparatus of FIG. 1 after completion of pushing with the cutting frame and the pusher device returned to their initial positions.

On completion of pushing, the clay batch 4 to be cut next is situated on the support plate 3 and the brick mouldings 7 are situated on the conveyor belt 9. The pusher means 5 are then moved vertically upwardly and the pusher bars 6 and 6′ are moved horizontally so that the pusher means is in the initial position as shown in FIG. 4. The cutter frame 1 and waste remover and conveyor 10 are also now in the initial positions thereof. The apparatus is, therefore, in position for a subsequent cutting operation.

While the invention has been described in connection with what is presently conceived to be the most practical and preferred embodiment, it is to be understood that the invention is not to be limited to the disclosed embodiment but on the contrary, is intended to cover various modifications and equivalent arrangements included within the spirit and scope of the appended claims, which scope is to be accorded the broadest interpretation of such claims so as to encompass all such equivalent structures and methods.

What is claimed is:

1. A method of cutting a block of material comprising the steps of feeding a block of material onto support means including spaced apart supports, subsequently moving a cutting frame, having a predetermined number of tensioned cutting wires positioned at an acute angle to the supports, in a substantially vertical plane from a first starting position to a second position through the block and between the supports so that the cutting wires cut completely through the block without interruption in the cutting motion, and thereafter removing the cut block from the support means, wherein the feeding of the block onto the support means and the removal of the cut block therefrom occurs substantially simultaneously in a single plane by pusher means.

2. A method according to claim 1, wherein the feeding and removing of blocks and cut blocks is effected by pusher means having a first pusher element for feeding a block to be cut towards and onto the support and a second pusher element spaced downstream from the first pusher element for removing the cut block from the support.

3. A method according to claim 2, wherein the first and second pusher elements move together in a substantially vertical plane to and from an operative pushing station, at which station the first and second pusher elements push the blocks from a starting position to a final position.

4. A method according to claim 1, 2 or 3, wherein the cutting frame, after cutting, moves in a substantially vertical plane to return to the starting position thereof during pushing of the block to be cut and the cut block by the pusher means, so that the pusher means does not contact the wires during the return movement of the cutting frame.

5. A method according to claim 4, wherein the pusher means moves downwardly with the cutting frame during cutting to a pushing station wherein, after cutting, the cutting frame moves upwardly to return to its starting position while the pusher means moves a block towards and onto the support means and at the same time removes a cut block from the support means, and wherein, after completion of said feed and removal, the pusher means moves upwardly a predetermined distance in a substantially vertical plane and thereafter moves in a substantially horizontal plane another predetermined distance to return to a position directly above the starting position at the operative pushing station.

6. A method according to claim 5, wherein the block is a clay batch from which brick mouldings are cut.

7. An apparatus suitable for use in cutting a block of material, such as clay, comprising support means including a slotted support device for supporting the block of material during cutting, pusher means including a first pusher for feeding a first block of material onto the support device and a second pusher spaced a predetermined distance downstream from the first pusher for removing a second block from the support device, said first and second pushers pushing in a single plane, and a cutting frame, having tensioned cutting wires, movable in a substantially vertical plane through a block supported by the support device and between the spaced apart supports therein to cut completely through the block without interruption of the cutting motion, said cutting wires lying in a plane extending at an acute angle to the plane of feed of the block onto the support means.

8. An apparatus according to claim 7, wherein the spaced apart first and second pushers substantially simultaneously push said first block onto the support device while the second pusher removes said block from the support device.

9. An apparatus according to claim 8, wherein the first and second pushers are movable in a substantially vertical plane to and from an operative pushing station, at which station the first and second pushers push the first and second blocks, respectively, from a starting position to a final position.

10. An apparatus according to claim 8 or 9, wherein the pusher means further includes rail means for supporting said first and second pushers so that said first and second pushers can move therealong during pushing.

11. An apparatus according to claim 10, wherein said rail means and said first and second pushers are movable together in a substantially vertical plane.

12. An apparatus according to claim 1, wherein said support means further includes first means for supporting the block during pushing thereof to said slotted supporting device and second means for receiving the block removed from said slotted supporting device.

13. An apparatus according to claim 12, wherein said first means is a roller table.

14. An apparatus according to claim 12 or 13, wherein the second means is a belt conveyor.

15. A method of cutting a block of material comprising the steps of feeding a block of material onto spaced apart supports, moving a cutting frame, having a predetermined number of tensioned cutting wires positioned at an acute angle to the supports, in a substantially vertical plane from a first starting position to a second finished position so that the cutting wires pass through the block and between the supports cutting the block without interruption in the cutting motion, and thereafter removing the cut block from the support means, wherein the feeding of a new uncut block and the removing of the cut block occur substantially simultaneously in a single plane by pusher means.

16. The method according to claim 15, wherein the feeding and removing of blocks is effected by simultaneously moving a first pusher element for feeding an uncut block onto the support and a second pusher element, spaced downstream from the support means.

17. Apparatus for cutting blocks of material comprising a slotted support device for supporting a block of material during cutting, pusher means including a first pusher assembly for feeding an uncut block of material onto the support device and a second pusher assembly operatively connected to and spaced a predetermined distance downstream from the first pusher assembly for removing a cut block from the support device, said first and second pusher assemblies pushing a single plane, and cutting means having at least one tensioned cutting wire mounted thereon, movable in a substantially vertical plane for cutting through a block supported by said support device without interruption of the cutting motion, said cutting wires being positioned at an acute angle to the plane of feed of the blocks.

18. An apparatus according to claim 17, wherein said spaced apart first and second pusher assemblies cooperate to substantially simultaneously push said uncut block onto said support device while removing said cut block therefrom.

* * * * *